US010995615B2

(12) United States Patent
Gates

(10) Patent No.: US 10,995,615 B2
(45) **Date of Patent: *May 4, 2021**

(54) METHOD FOR OPTIMIZING MINING PRODUCTION

(71) Applicant: Caterpillar Inc., Deerfield, IL (US)

(72) Inventor: Kevin E. Gates, St. Lucia (AU)

(73) Assignee: Caterpillar Inc., Peoria, IL (US)

( * ) Notice: Subject to any disclaimer, the term of this patent is extended or adjusted under 35 U.S.C. 154(b) by 213 days.

This patent is subject to a terminal disclaimer.

(21) Appl. No.: 16/026,388

(22) Filed: Jul. 3, 2018

(65) Prior Publication Data

US 2020/0011175 A1 Jan. 9, 2020

(51) Int. Cl.
*E21C 41/26* (2006.01)
*G06Q 50/02* (2012.01)

(52) U.S. Cl.
CPC ..... *E21C 41/26* (2013.01); *G06Q 50/02* (2013.01)

(58) Field of Classification Search
CPC ..... E21C 41/28; E21C 41/30; E21C 41/31; E21C 47/02; E21C 49/00; E21C 49/02; E21C 49/04; E21C 41/00; E21C 41/04; E21C 41/10; E21C 41/14; E21C 41/16; E21C 41/18; E21C 41/20; E21C 41/22; E21C 41/24; E21C 41/26; E21C 41/32; E21C 47/00; E21C 47/04; E21C 47/06; E21C 47/08; E21C 47/10; E21F 13/00; E21F 13/002; E21F 13/004; E21F 13/006; E21F 13/02; E21F 13/025; E21F 13/06; E21F 13/063; G05D 2201/021; G06Q 50/02
USPC ..... 701/50
See application file for complete search history.

(56) References Cited

U.S. PATENT DOCUMENTS

| | | | | |
|---|---|---|---|---|
| 6,529,812 | B1 | 3/2003 | Koehrsen et al. | |
| 6,741,921 | B2 | 5/2004 | Cohen et al. | |
| 8,190,173 | B2 | 5/2012 | Olson | |
| 9,234,426 | B2 | 1/2016 | Morrison et al. | |
| 9,697,654 | B2 | 7/2017 | Asada et al. | |
| 2006/0190219 | A1* | 8/2006 | Froyland | E21C 41/26 703/1 |

(Continued)

*Primary Examiner* — David J Bagnell
*Assistant Examiner* — Michael A Goodwin
(74) *Attorney, Agent, or Firm* — Calfee, Halter & Griswold LLP

(57) ABSTRACT

A system for mining site production planning includes a control system configured to specify a problem-solving technique and associated optimization problem for a mining site by setting production goals and priorities for each of loading tools, processors, production arcs, and materials of the mining site, sorting the production arcs in an order based on travel distances, modifying the order based on the production goals for each of the loading tools, processors, production arcs, and/or materials, and further modifying the order based on set priorities for the loading tools, processors, production arcs, and/or materials. In addition, target values are set for each of the loading tools, processors, and production arcs according to their order of the sorted production arcs. The control system is further configured to solve the optimization problem to produce production values for each of the loading tools, processors, and production arcs based on the target values.

20 Claims, 15 Drawing Sheets

(56) References Cited

U.S. PATENT DOCUMENTS

| | | | | |
|---|---|---|---|---|
| 2006/0265342 | A1* | 11/2006 | Froyland | G06Q 99/00 705/500 |
| 2016/0247395 | A1 | 8/2016 | Sugihara et al. | |
| 2017/0138193 | A1* | 5/2017 | Kawai | E21C 41/16 |
| 2019/0153701 | A1* | 5/2019 | Gates | G06Q 10/0631 |

* cited by examiner

METHOD FOR OPTIMIZING MINING PRODUCTION

TECHNICAL FIELD

The present disclosure generally relates to mining site production planning and, more particularly, to a control system for specifying and solving an algorithm and associated optimization problem for producing production values for loading tools, processors and production arcs of a mining site.

BACKGROUND

In a number of industries, vehicles or other transportation methods are used to pick up loads from one location and deliver the loads to another location. An exemplary industry that works within this model is the mining industry, in which material transportation involves a mining machine picking up a load of ore from a loading tool and transporting that ore to a processor. Additionally, processed ore may need to be transported to another site for additional processing. Because of this, material transport is an important aspect in the mining industry and can represent a large percentage of costs associated with mining.

A dispatching system for controlling the usage of mining machines within a mine can be used to optimize material transport and reduce costs. The essence of a dispatching system is to determine, every time a mining machine leaves a location in the mine, where the "best" place is for that mining machine to go. Determining the "best" place for the mining machine to go involves optimizing an objective, such as, for example, maximizing the overall production of the mine, minimizing hauling distances, or maximizing desired production.

Two approaches have typically been used for dispatching systems—single-stage and multi-stage. Single-stage systems dispatch mining machines according to one or several criteria. However, single-stage systems do not take into account any production targets or constraints. Single-stage systems are often heuristic, or non-mathematical, rules to determine the mining machine assignments. Multi-stage systems, on the other hand, divide dispatching problems into multiple stages. Typically, multi-stage systems include an upper stage, which consists of calculating a production plan that optimizes use of mining equipment, and a lower stage, which consists of calculating individual assignments according to the restrictions and assignment groups in usage and according to deviations from the production plan. However, the production plan implies the most productive paths (i.e., shortest paths) are returned in the optimal solution.

U.S. Pat. No. 9,697,654, titled "System for managing mining machine and method for managing mining machine," discloses a system for managing a mining machine and estimating tire damage to vehicles. The system obtains positional information from mining machines, such as dump trucks, to determine a reference traveling path. The system may then estimate tire damage from positional information about a reference traveling path, actual traveling speed, and the load acting on the wheels. The system may also estimate tire damage by each operator. The system may then generate a report.

SUMMARY

In accordance with embodiments of this invention, a system for mining site production planning includes a mining site including materials to be mined, loading tools, processors, and production arcs. The system also includes a control system configured to specify a problem-solving technique and associated optimization problem for a mining site by setting production goals for each of loading tools, processors, production arcs, and materials to be mined of the mining site, sorting the production arcs in an order based on travel distances, modifying the order of the sorted production arcs based on the production goals for at least one of the loading tools, processors, production arcs, or materials to be mined, and modifying the order of the sorted production arcs based on a production priority for at least one of the loading tools, processors, production arcs, or materials to be mined. The problem-solving technique is also specified by setting target values for each of the loading tools, processors, and production arcs according to the order of the sorted production arcs. The control system is further configured to solve the optimization problem to produce production values for each of the loading tools, processors, and production arcs based on the target values.

In accordance with other embodiments, there are provided methods for mining site production planning of a mining site which includes materials to be mined, loading tools, processors, and production arcs. The method includes receiving production goals for each of loading tools, processors, production arcs, and materials to be mined of a mining site, at a controller. The method also includes sorting the production arcs in an order based on travel distances, modifying the order of the sorted production arcs based on the production goal for at least one of the loading tools, processors, production arcs, or materials to be mined, modifying the order of the sorted production arcs based on a production priority for at least one of the loading tools, processors, production arcs, or materials to be mined, and setting target values for each of the loading tools, processors, and production arcs according to the order of the sorted production arcs, using the controller. The method further includes producing production values for each of the loading tools, processors, and production arcs based on the target values, using the controller.

In accordance with other embodiments, there are also provided control systems for mining site production planning wherein a mining site includes materials to be mined, loading tools, processors, and production arcs. The control system includes a controller programmed to specify a problem-solving technique and associated optimization problem for a mining site by receiving production goals for each of loading tools, processors, production arcs, and materials to be mined of the mining site, and sorting the production arcs in an order. The controller is also programmed to modify the order of the sorted production arcs based on the production goals for at least one of the loading tools, processors, production arcs, or materials to be mined, modify the order of the sorted production arcs based on a production priority for at least one of the loading tools, processors, production arcs, or materials to be mined, and set target values for each of the loading tools, processors, and production arcs according to the order of the sorted production arcs. The controller is further programmed to solve the optimization problem to produce production values for each of the loading tools, processors, and production arcs based on the target values.

Other features and aspects will be apparent from the following description and accompanying drawings.

BRIEF DESCRIPTION OF THE DRAWINGS

Further features and advantages of the invention will become apparent from the description of embodiments using the accompanying drawings. In the drawings.

DETAILED DESCRIPTION

Figure 1:
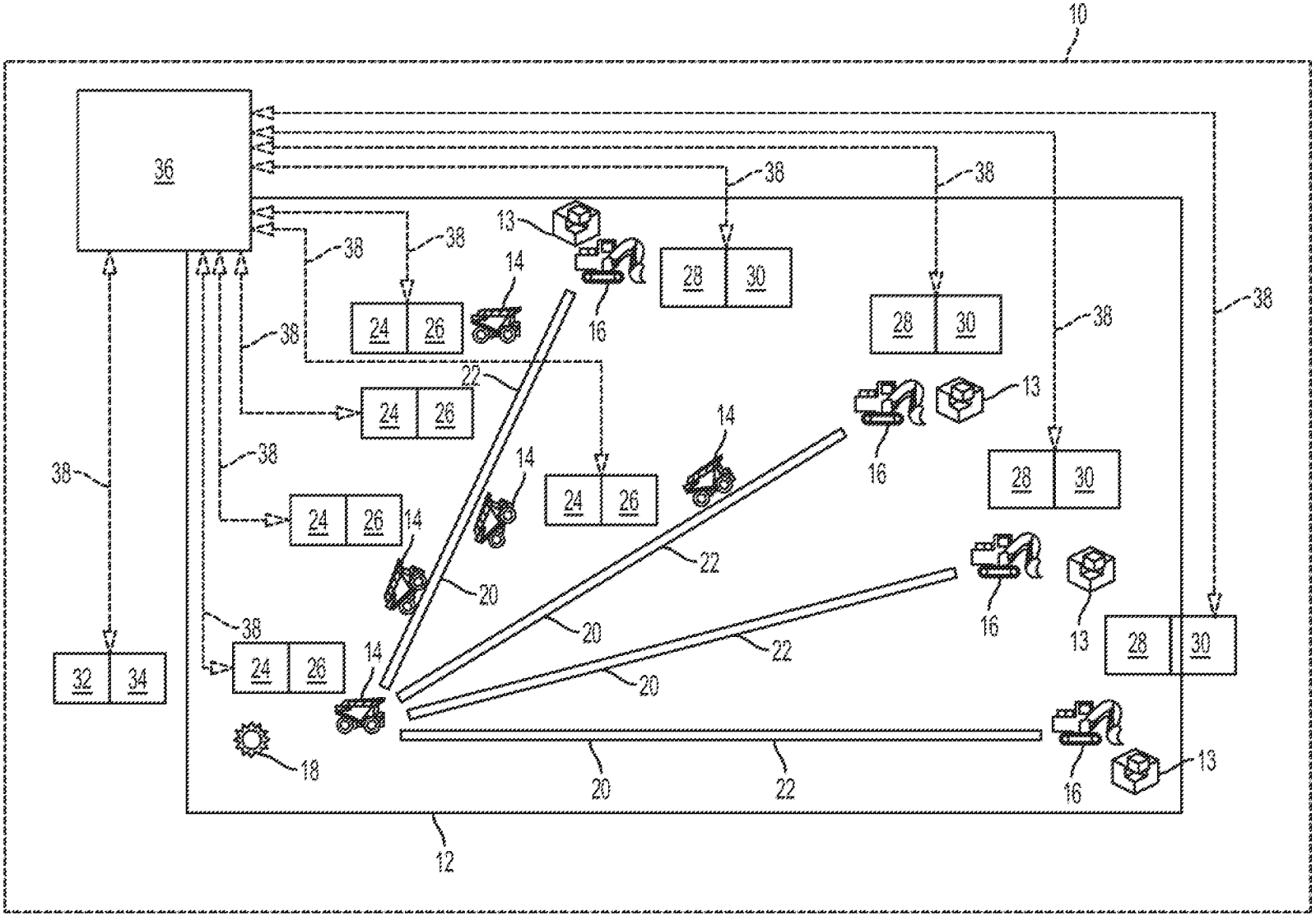
FIG. 1 is a schematic diagram of an exemplary system for mining site production planning, according to the present disclosure.

Reference will now be made in detail to specific embodiments or features, examples of which are illustrated in the accompanying drawings. Wherever possible, corresponding or similar reference numerals will be used throughout the disclosure and accompanying drawings to refer to the same or corresponding parts.

FIG. 1 illustrates a system 10 consistent with an exemplary embodiment of the present disclosure. As shown diagrammatically in FIG. 1, the system 10 includes a mining site 12, which may include one or more materials 13 to be mined, such as ore or other materials, a plurality of mining machines 14, such as mining trucks, a plurality of loading tools 16, and a plurality of material processors 18, such as crushers, stockpiles, or dumps, for example. The materials 13 to be mined may include iron ore, copper, lead, soil, gold, or any other material which is mined. The mining machines 14 may transport one or more materials 13 from the loading tools 16 to the material processors 18 across a plurality of production arcs 20, or paths. The production arcs 20 may also represent return arcs 22, along which the mining machines 14 may return, in an empty state, to one of the loading tools 16. Although a specific number of materials 13, mining machines 14, loading tools 16, material processors 18, production arcs 20, and return arcs 22 are shown, the mining site 12 may include any number or combination of these component parts of the mining site 12. The illustration is provided for exemplary purposes only.

The mining machines 14 may each include an onboard system 24 and/or a monitoring device 26. The onboard system 24 may be an electronic system and may include a user interface, which may include a display element, for providing information to an operator and/or receiving control instructions or other input from the operator. Further, the onboard system 24 and/or the monitoring device 26 may be equipped with a position sensing system, such as a global positioning system (GPS), a laser positioning system, and/or an inertial navigation unit, and wireless communication capabilities. The monitoring device 26 may also be electronic and may be equipped with sensors and/or other components to monitor travel time, detect potential mechanical failures, quantify the load of the mining machine 14, and/or obtain other information about the mining machine 14 and its operation. In a preferred embodiment, the onboard system 24 and/or monitoring device 26 may produce a signal indicative of mining machine 14 equipment and operational performance.

The loading tools 16 may retrieve and deliver materials 13 to the mining machines 14 at various locations throughout the mining site 12. The loading tools 16 may include shovels or other equipment that delivers loads to the mining machines 14. Each loading tool 16 may include an onboard system 28 and/or monitoring device 30, similar to those described above. That is, the onboard system 28 may include a user interface, which may include a display element, for providing information to the operator and/or receiving control instructions or other input from the operator. Further, the onboard system 28 and/or monitoring device 30 may be equipped with a position sensing system, such as a GPS, a laser positioning system, and/or an inertial navigation unit, and wireless communication capabilities. In addition, the monitoring device 30 may monitor information about the loading tool 16, such as, for example, a current level of ore available for pick-up. Further, the monitoring device 30 may be equipped to identify the type of load dug by the loading tool 16.

The material processors 18 (only one of which is shown) may receive materials 13 from the mining machines 14 for processing. For example, the material processors 18 may include crusher machines. Each of the material processors 18 may also include an onboard system 32 and/or monitoring device 34, which may be located on or near the material processors 18. The onboard system 32 may include a user interface, which may include a display element, for providing information to the operator and/or receiving control instructions or other input from the operator. The onboard system 32 and/or monitoring device 34 may be equipped with wireless communication capabilities and may monitor information about the material processor 18, such as, for example, a current level of ore for processing. Further, the monitoring device 34 may also include static information, such as the total capacity or processing rate of the material processor 18.

The production arcs 20 are representative of the flow of material 13 at the mining site 12. That is, the production arcs 20 represent the flow resulting from loading operations at the loading tools 16 and then following the material 13 through the road network and the unloading operations at material processors 18. For example, each production arc 20 may be defined by the loading tool 16, material processor 18, mining machine 14, material 13 loaded into the mining machine 14, and the path from the loading tool 16 to the material processor 18. The return arcs 22 describe the return path of the mining machine 14, when it travels in an empty state from the material processor 18 back to the loading tool 16 along a path.

The mining machines 14 may be dispatched to and from loading tools 16 and/or material processors 18 via a control system 36. For example, after the mining machine 14 delivers its load to a material processor 18, the control system 36 may direct the mining machine 14 to a specific one of the loading tools 16 or another location of the mining site 12. The control system 36 may communicate with, and exchange information with, the onboard systems 24, 28 and 32 and/or monitoring devices 26, 30 and 34 of the mining machines 14, loading tools 16, and material processors 18 via wireless communications lines 38.

Figure 2:
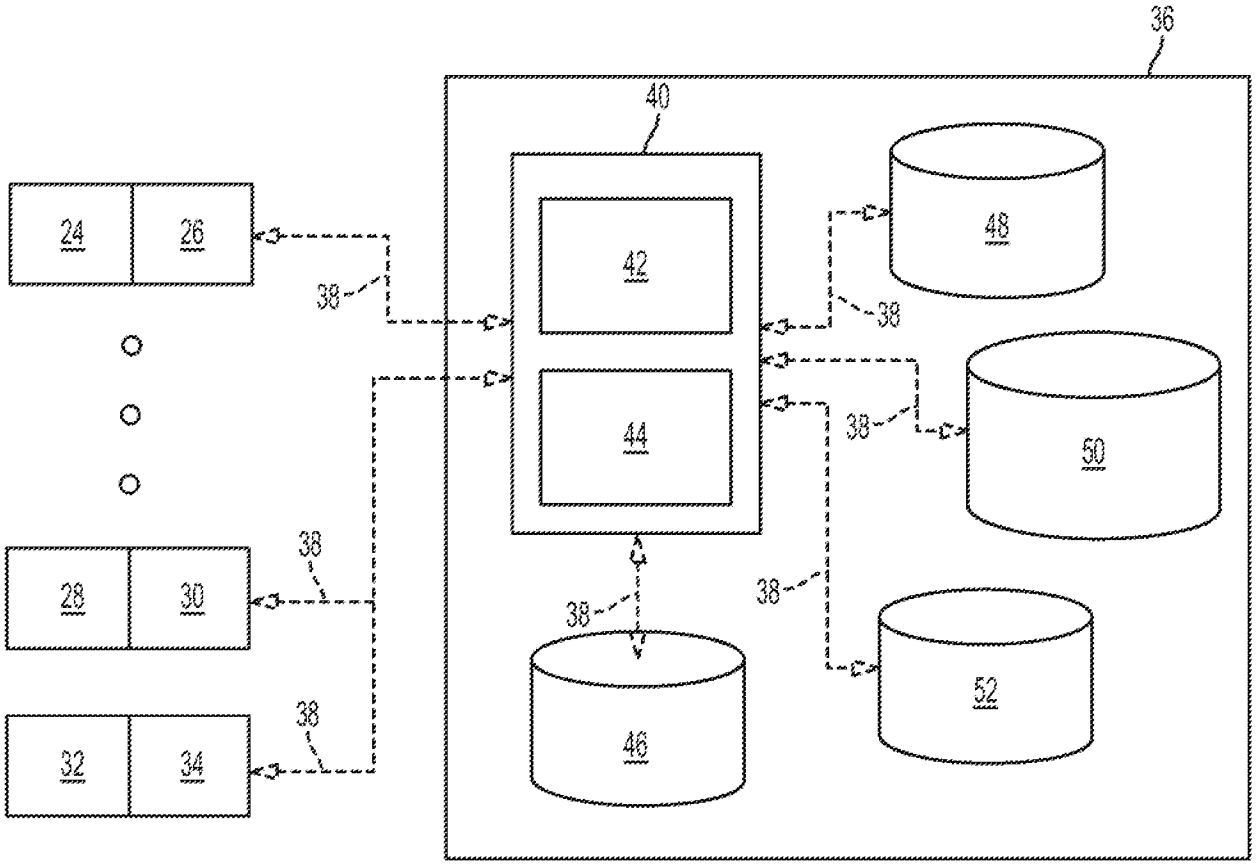
FIG. 2 is a block diagram of the control system of FIG. 1.
Figure 3:
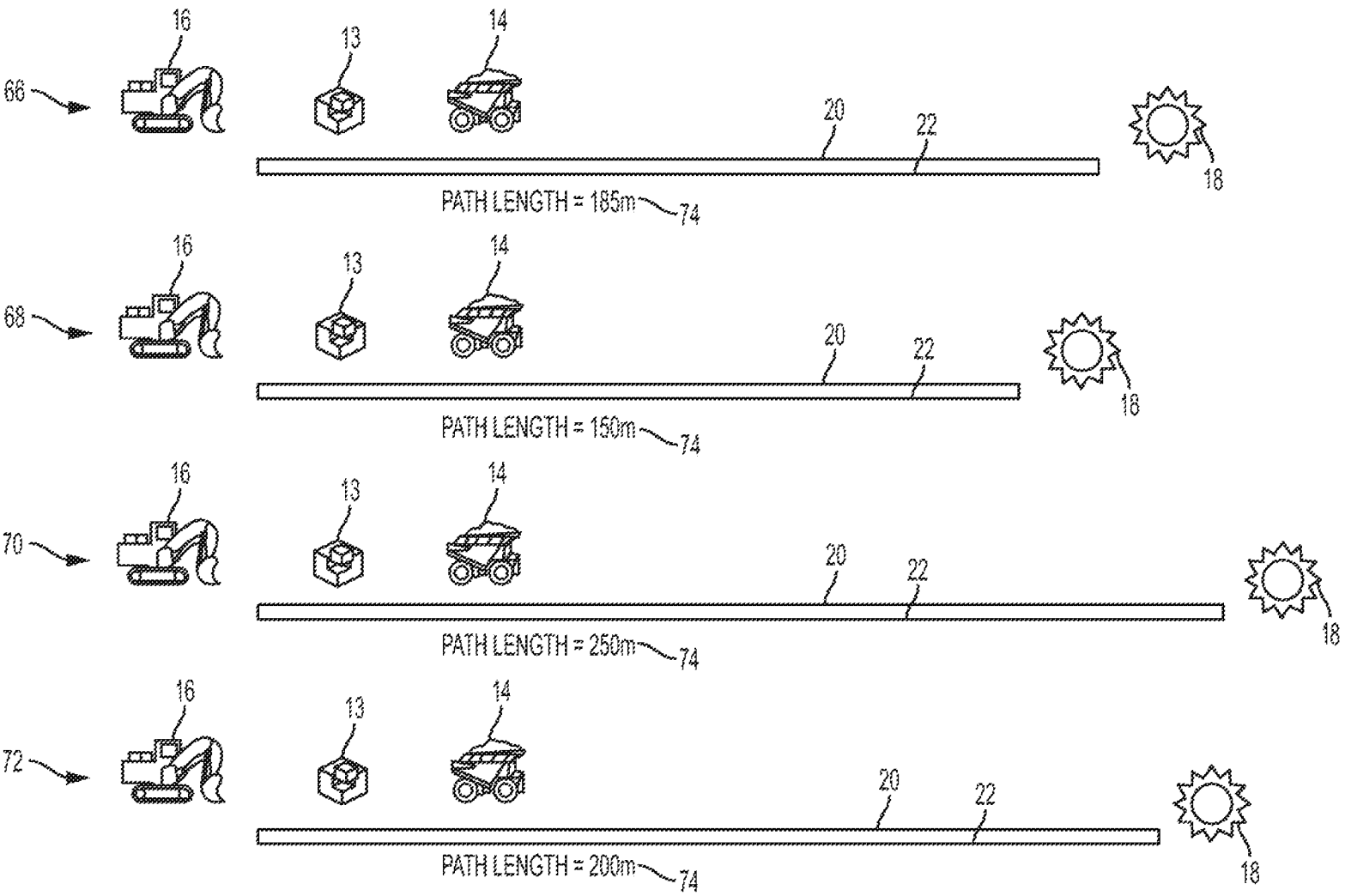
FIG. 3 is a schematic representation of a stage in an exemplary method of mining site production planning, according to an aspect of the present disclosure.

As shown in FIG. 2, the control system 36, according to an exemplary embodiment, may include a controller 40, such as an electronic controller, with the controller 40 including a processor 42 and a memory 44. The controller 40 may also include storage, a display, a network interface and an input/output device, for example. The processor 42 may execute unique sets of instructions, which may be implemented as computer readable program code, stored in the memory 44, such that the controller 40 and/or control system 36 and/or a portion thereof is configured as a special purpose system. In particular, hardware, software, and particular sets of instructions may transform the control system 36 into the system 10 for mining site production planning described herein, or portions thereof.

The controller 40 may be in communication with one or more databases, such as, for example, a process database 46, a configuration database 48, a route assignments database 50 and a mine image database 52. The process database 46 may include instructions for performing a variety of processes required to optimize transport of the one or more materials 13. For example, the process database 46 may include instructions for performing steps, or stages, of the mining site production planning method described herein. Further, the process database may include instructions for mining or loading material, hauling material, or processing material.

The configuration database 48 may include current system settings, such as choice of optimization criterion, specifications of blending requirements, and other solution parameters, for example. The route assignments database 50 may include route dispatch assignments, before and/or after the dispatch assignments are provided to the mining machines 14, and various other dispatch information. The mine image database 52 may include information about the mining site 12, including, for example, information about each piece of equipment (such as location and current status), information about material 13 excavated by each loading tool 16, the current blending at each material processor 18, and other relevant mine information. Although specific examples are provided, the number of databases 46, 48, 50 and 52 and/or information provided in the various databases 46, 48, 50 and 52 may vary depending on specifics of the particular application.

The control system 36 may be programmed and/or configured to calculate a production plan for the mining site 12 and, further, to produce dispatch assignments for the mining machines 14 based on the production plan. In particular, the control system 36 may be configured to specify a problem-solving technique and associated optimization problem for the mining site 12, and solve the optimization problem using a solution engine. At a first stage, as illustrated in FIGS. 3-8, production arc production goals 60, loading tool production goals 62, processor production goals 64, and material production goals 65 may be calculated for each of the loading tools 16, material processors 18, production arcs 20, 22, and the material 13 being mined, respectively. The production goals 60, 62, 64, 65 may be calculated from a variety of parameters.

Referring to FIGS. 3-14, a first row 66 illustrates a first production arc 20, a second row 68 illustrates a second production arc 20, a third row 70 illustrates a third production arc 20 and a fourth row 72 illustrates a fourth production arc 20. While the illustrated embodiment depicts a mining site 12 with four production arcs 20, the mining site 12 may include any number of production arcs 20 and, thus, rows. Further, while the illustrated production arcs 20 are labeled as first, second, third, and fourth rows 66, 68, 70, 72, it will be understood that the production arcs 20 may be reordered and that the terms first row 66, second row 68, third row 70, and fourth row 72 are merely descriptions to differentiate the particular production arcs 20 based the starting order of the production arcs 20.

One phase of setting the production goals 60, 62 64, 65 is to consider the capacity of the loading tools 16. The capacity of the loading tools 16 is the amount of material 13 that a particular loading tool 16 may load onto mining machines 14 in a given amount of time. Each loading tool 16 has a nominal loading capacity determined by the time required by the loading tool 16 to load each class of mining machine 14. The number of mining machines 14 that can operate with the loading tool 16 because of compatibility and availability or due to locks and bars from the loading tool 16 or the destination material processor 18 may lower the loading tool capacity. The speed and capacity of the destination material processor 18 may also lower the operational loading tool capacity. Additionally, any goals or limits imposed by the mine operators may also lower the operational loading tool capacity.

Another phase is to consider the capacity of the material processors 18. The capacity of the material processors 18 is the amount of material 13 that a particular processor 18 may process or receive in a given amount of time. Each material processor 18 has a nominal processing capacity determined by the time required by the material processor 18 to handle each class of mining machine 14. The number of mining machines 14 that can operate with the material processor 18 because of compatibility and availability or due to locks and bars from the associated loading tool 16 or the material processor 18 may lower the processor capacity. Additionally, any goals or limits imposed by the mine operators may also lower the operational processor capacity.

Another phase is to consider the capacity of each of the production arcs 20 and associated return arcs 22 and the total production capacity. The capacity of the production arcs 20 is the amount of material 13 that a particular production arc 20 may haul or move in a given amount of time. The number of mining machines 14 available for the production arcs 20 and associated return arcs 22 should also be considered. Additionally, the type of mining machines 14 available for the production arcs 20 should be considered as the amount of material carried by each mining machine 14 and the speed at which the mining machine 14 may travel may vary depending on machine type. Further, any goals set on the production arcs 20 and associated return arcs 22 may lower the arc capacity.

Figure 4:
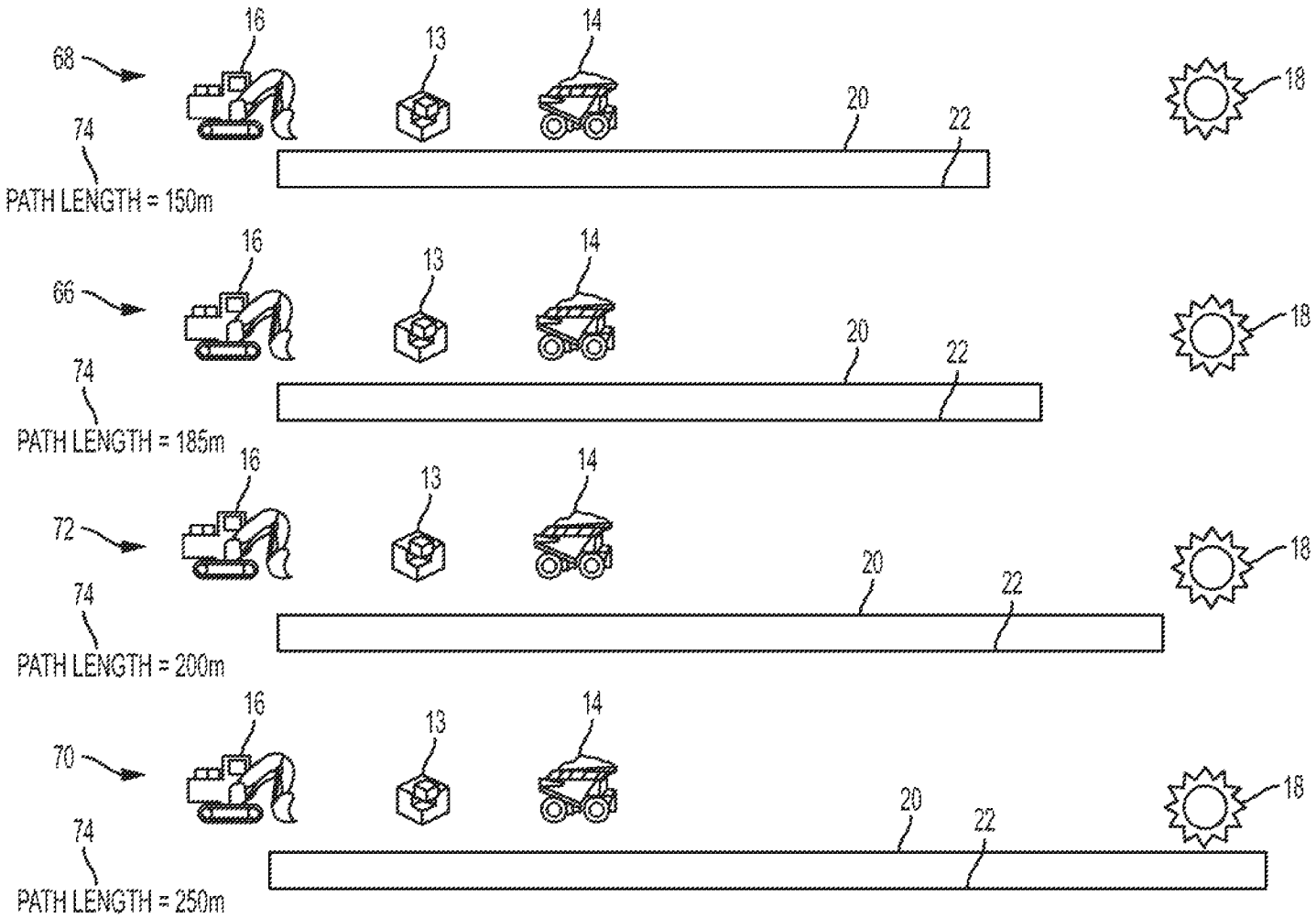
FIG. 4 is a schematic representation of another stage in the exemplary method of mining site production planning, according to an aspect of the present disclosure.

FIG. 4 depicts a second stage of the method for calculating a production plan for the mining site 12, and includes sorting the production arcs 20 in an order based on travel distances 74, or path lengths. As travel distances 74 correlate to the time it takes a mining machine 14 to deliver material 13 from a loading tool 16 to a material processor 18, prioritizing mining production by ordering a list of production arcs 20 such that the production arcs 20 the shortest travel distances 74 being allocated before production arcs 20 with a longer travel distance 74 results in more material 13 being moved to material processors 18 as the mining machines 14 may make more trips. That is, since the maximum production will be produced by using the shortest travel distance 74, this stage includes sorting all of the available production arcs 20 by travel distances 74, with the production arc 20 with the shortest travel distance 74 (illustrated in FIG. 4 as second row 68) at the top or the list of sorted production arcs 20, and the remaining production arcs 20 in the list based on the ascending order of travel distances 74. Ordered as such, the first row 66 would be after the second row 68, followed by the fourth row 72, and then the third row 70.

Figure 5:
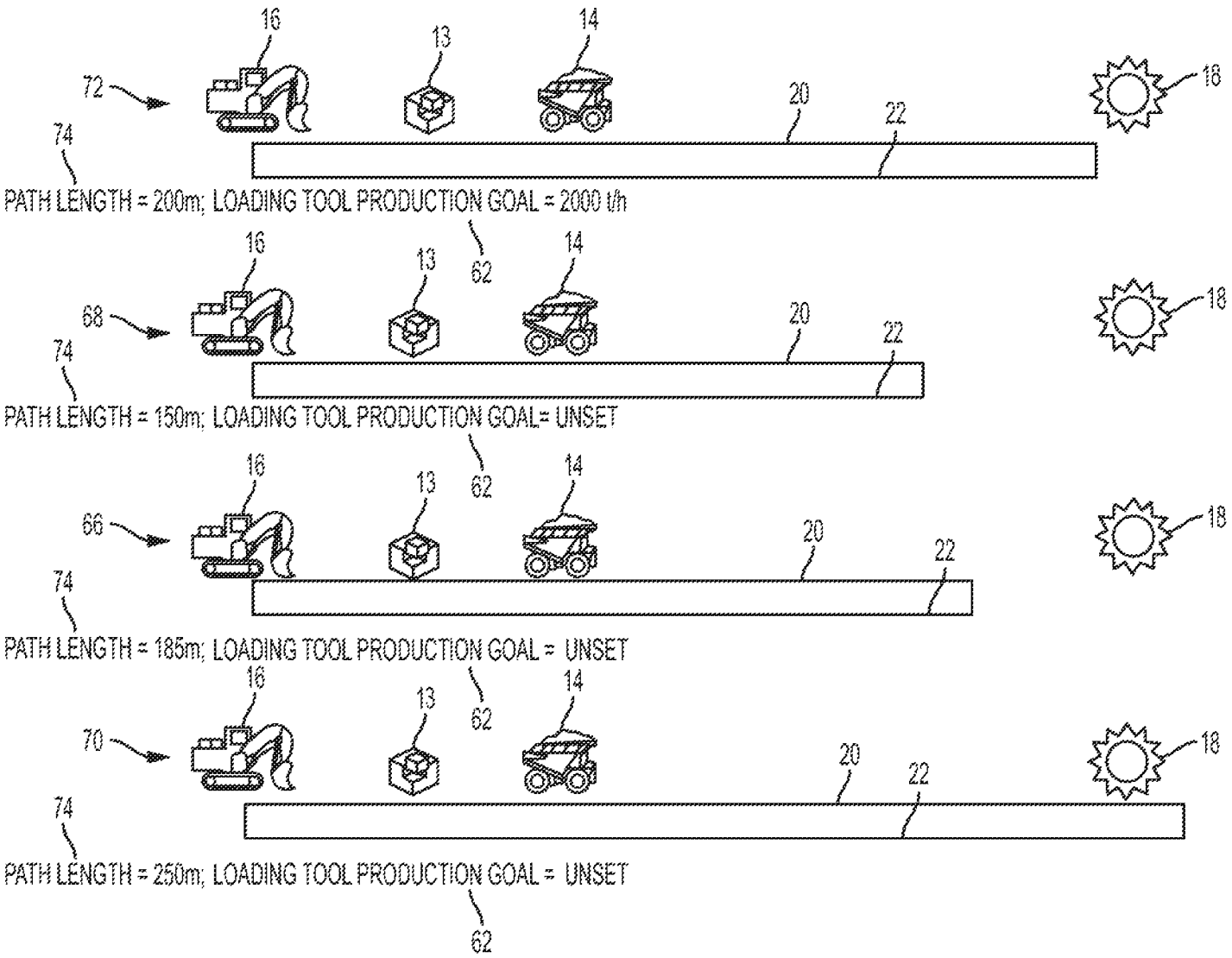
FIG. 5 is a schematic representation of another stage in the exemplary method of mining site production planning, according to an aspect of the present disclosure.
Figure 6:
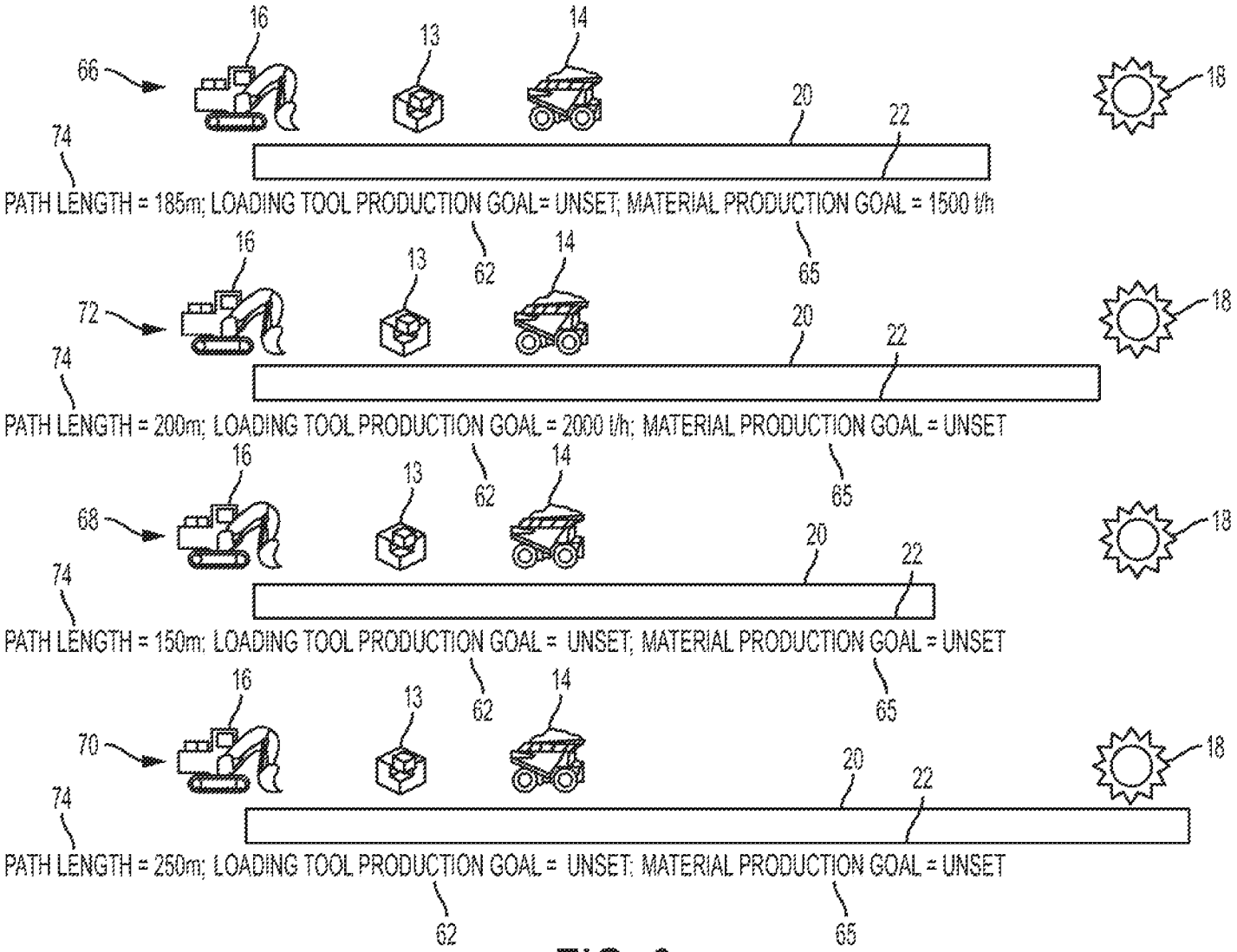
FIG. 6 is a schematic representation of another stage in the exemplary method of mining site production planning, according to an aspect of the present disclosure.
Figure 7:
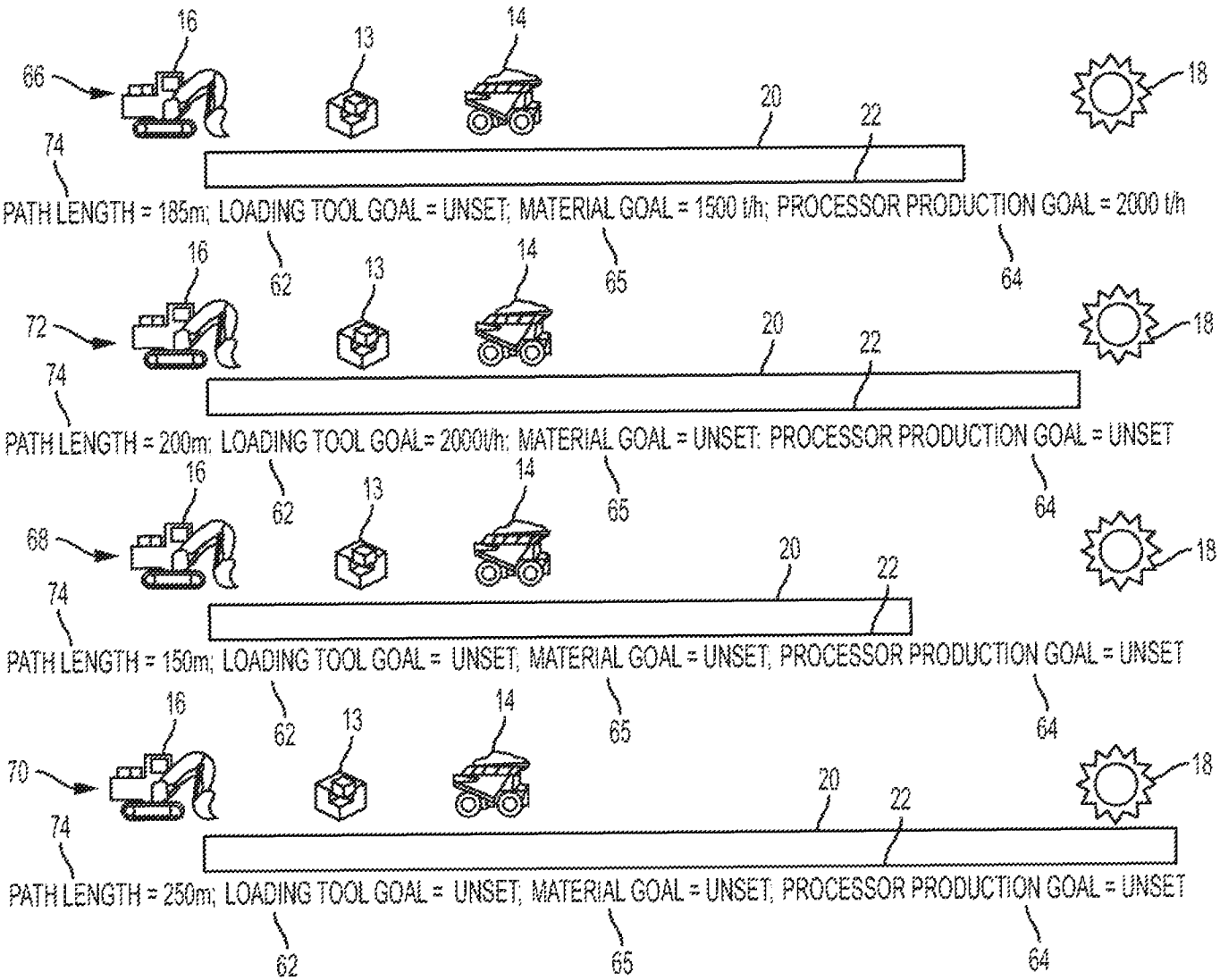
FIG. 7 is a schematic representation of another stage in the exemplary method of mining site production planning, according to an aspect of the present disclosure.

Turning now to FIGS. 5-7, the order of the sorted production arcs 20, as illustrated in FIG. 4, may be modified based on the established production goals (e.g., production arc production goals 60, loading tool production goals 62, processor production goals 64, and material production goals 65). That is, the list may be modified by considering each of the production goals set by the mine operators, such as in inverse priority. Any restrictions on production, such as "no more than" goals, may then be set on the arc capacity to ensure they are followed. The "at least" and "equals" goals may then be considered and the associated production may be positioned at the top of the sorted list. This set ensures that all the goals are considered and the explicit desired production arcs are at the top of the sorted production arc list. While the term "modified" has been used to describe the subsequent arrangement of production arcs 20, it will be appreciated that the order of the sorted production arcs 20 may only be re-sorted and need not be modified in that the order of the sorted production arcs 20 may not change at each iteration.

The order of the sorted production arcs 20 may be modified in successive iterations with each iteration modifying the order of the sorted production arcs 20 based on one or more of the established production goals, with the production arc 20 with the highest production goal at the top. The iterations may modify the sorted production arcs in inverse priority of production goals with the first iteration modifying the order of sorted production arcs 20 based on the least important production goal and the last iteration modifying the order of the resulting sorted production arcs 20 based on the most important production goal. As such the resulting order of the sorted production arcs 20 may be ordered based on the most important production goal and then each other production goal in descending order. Further, the list of established production goals does not need to be complete and production arc production goals 60, loading tool production goals 62, processor production goals 64, and material production goals 65 do not need to be set for each production arc 20, 22, loading tool 16, material processor 18, and material 13 to be mined. For example, production goals may be established for only one or more of the production arcs 20, 22, loading tools 16, material processors 18, and/or materials 13 to be mined.

Referring to FIGS. 5 through 7, the order of the sorted production arcs 20, as illustrated in FIG. 4, may be modified according to the loading tool production goals 62, the processor production goals 64, and/or the material production goals 65. As shown in FIG. 5, the order of the sorted production arcs 20, as illustrated in FIG. 4, may be first modified based on loading tool production goals 62. In the illustrated embodiment, the loading tool 16 of the fourth row 72 has a loading tool production goal 62 of 2000 tons per hour (t/h) and the remaining rows 66, 68, 70 do not have a set loading tool production goal 62. Ordered as such, the fourth row 72 would be first and the remaining rows 66, 68, 70 would remain ordered based on travel distances 74.

As shown in FIG. 6, the order of the sorted production arcs 20 illustrated in FIG. 5 may be modified based on material production goals 65. In the illustrated embodiment, the first row 66 has a material production goal 65 of 1500 tons per hour (t/h) and the remaining rows 68, 70, 72 do not have a set material production goal 65. Ordered as such, the first row 66 would be first 66 as it has the highest (only) material production goal 65, the fourth row 72 would be second as it had the highest loading tool production goal 62, and the remaining rows 68, 70 would remain ordered based on travel distances 74.

As shown in FIG. 7, the order of the sorted production arcs 20 illustrated in FIG. 6 may then be modified based on processor production goals 64. In the illustrated embodiment, the first row 66 has a processor production goal 64 of 2000 tons per hour (t/h) and the remaining rows 68, 70, 72 do not have a set processor production goal 64. Ordered as such, the first row 66 would be first 66 as it has the highest (only) processor production goal 64 and highest material production goal 65, the fourth row 72 would be second as it had the highest loading tool production goal 62, and the remaining rows 68, 70 would remain ordered based on travel distances 74.

Figure 8:
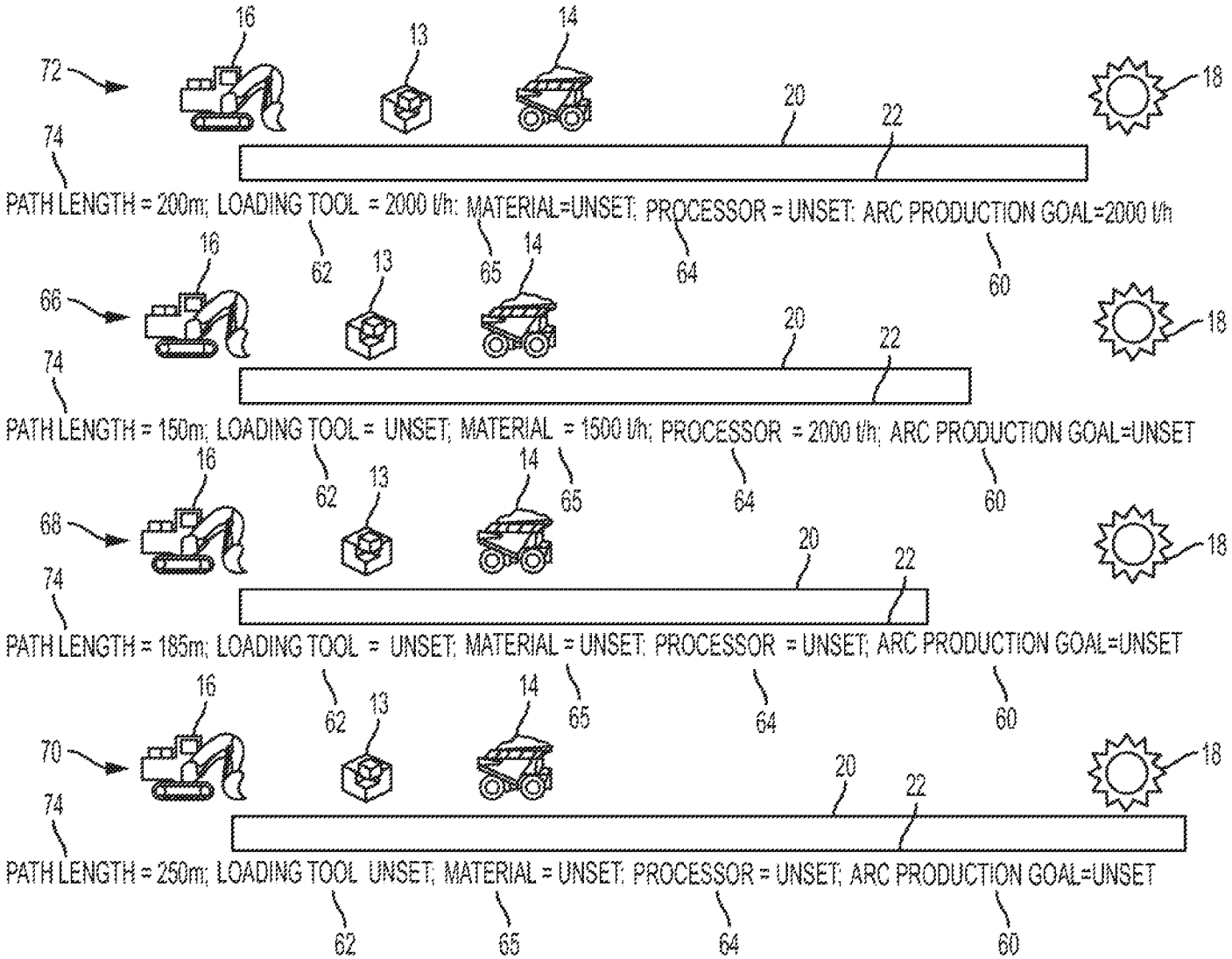
FIG. 8 is a schematic representation of yet another stage in the exemplary method of mining site production planning, according to an aspect of the present disclosure.

As shown in FIG. 8, the order of the sorted production arcs 20 illustrated in FIG. 7 may then be modified based on the production arc production goals 60. In the illustrated embodiment, the fourth row 72 has a production arc production goal 60 of 2000 tons per hour (t/h) and the remaining rows 66, 68, 70 do not have a set production arc production goal 60. Ordered as such, the fourth row 72 would be first as it has the highest (only) production arc production goal 60, the first row 66 would be second as it has the highest processor production goal 64 and highest material production goal 65, and the remaining rows 68, 70 would remain ordered based on travel distances 74.

In the illustrated example, the sorted production arcs 20 are modified based on production goals in inverse priority and are reordered based on loading tool production goals 62 first, material production goals 65 second, processor production goals 64 third, and production arc production goals 60 last. As such, the sorted production arcs 20 are rearranged into an order that reflects an order which first emphasizes production arc production goals 60, then processor production goals 64, then material production goals 65, and then loading tool production goals 62. Such an order of sorted production arcs 20 emphasizes the goals of the particular production arcs 20 and then the end or down-stream goals of the mining operation such that the sorted production arcs 20 emphasize the particular material processor 18 that materials 13 should be sent to and then the identified material 13 to be mined.

While the order of the sorted production arcs 20 in the illustrated embodiment is modified by loading tool production goals 62 first, material production goals 65 second, processor production goals 64 third, and production arc production goals 60 last, it will be understood that the example of FIGS. 5-8 is only illustrative of the general process of reordering production arcs 20 based on production goals 60 62, 64, 65 and is not exhaustive of the possible reordering. For example, the sorted production arcs 20 may be modified in any order of production goals 60, 62, 64, 65, including being modified by one, two, three, or all four production goals 60, 62, 64, 65. Further, the sorted production arcs 20 may be modified based on two or more production goals at once, such as by a top, second, third, etc. production goal for any of the production goals 60 62, 64, 65.

Figure 9:
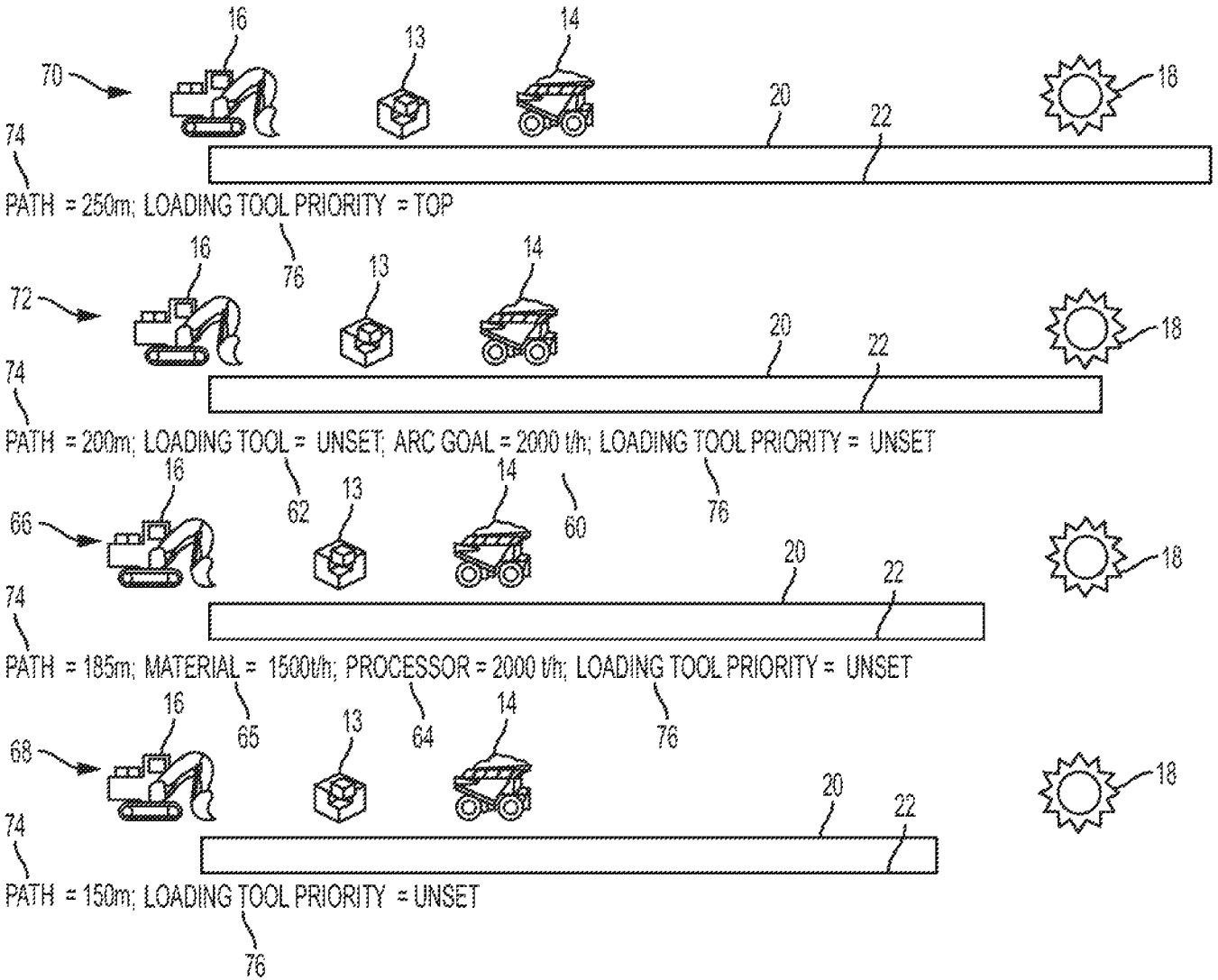
FIG. 9 is a schematic representation of yet another stage in the exemplary method of mining site production planning, according to an aspect of the present disclosure.
Figure 10:
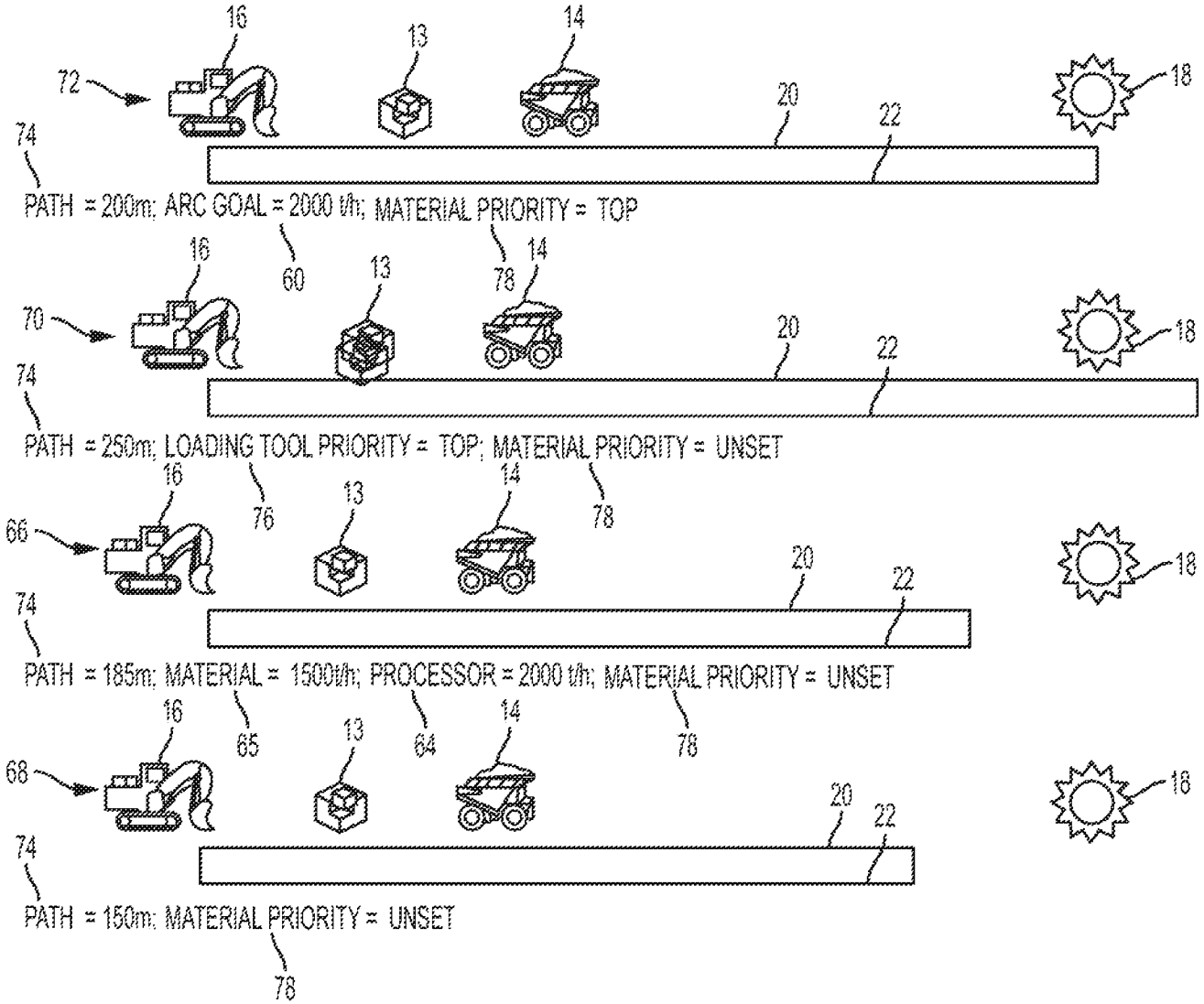
FIG. 10 is a schematic representation of yet another stage in the exemplary method of mining site production planning, according to an aspect of the present disclosure.
Figure 11:
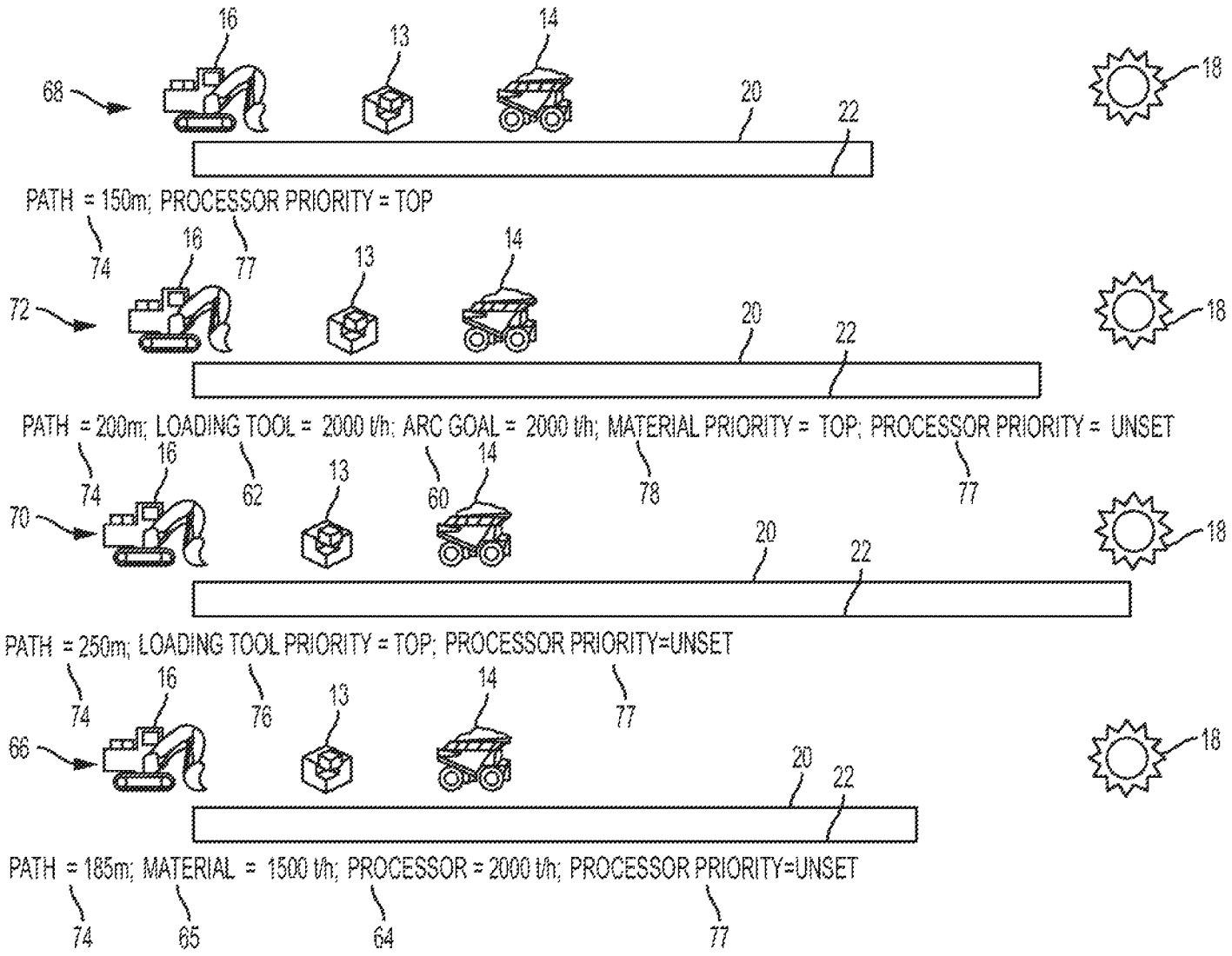
FIG. 11 is a schematic representation of yet another stage in the exemplary method of mining site production planning, according to an aspect of the present disclosure.

The control system 36 may also be configured to specify a problem-solving technique and associated optimization problem for the mining site 12, and solve the optimization problem using a solution engine, based on production priorities of the mining site 12. As illustrated in FIGS. 9-11, production arc priorities 75, loading tool priorities 76, processor priorities 77, and material priorities 78 may be set or otherwise calculated for each of the loading tools 16, material processors 18, production arcs 20, 22, and the material 13 being mined, respectively. The priorities 75, 76, 77, 78 may be set or calculated from a variety of parameters and may represent the explicit or implicit goals of the mining site 12. The priorities 75, 76, 77, 78 may be set to prioritize production for a particular mining machine 14, loading tool 16, material processor 18, production arc 20, 22, or material 13 to be mined and/or carried to optimize the mining operation. The established priorities may reflect mining operation goals such as the most utilization of the most efficient loading machine, the most production of the most profitable material, the least amount of fuel consumed by the mining operations, etc.

For example, the priorities 75, 76, 77, 78 may be set to indicate that most production should come for a particular material 13 being mined (illustrated in FIG. 10 as the fourth row 72) and/or from a particular loading tool 16 (illustrated in FIG. 9 as the third row 70), that the most material 13 should go to a particular material processor 18 (illustrated in FIG. 11 as the second row 68), or that the most material 13 should go by a particular production arc 20. The material production priorities 75, 76, 77, 78 may correspond to the mining machines 14, loading tools 16, material processors 18, and/or production arcs 20 associated with the particular materials 13 to be mined. The priorities 75, 76, 77, 78 may be preset by a mining site operator, otherwise calculated or determined from a variety of parameters, and/or continuously updated throughout the mining operation. The potential production priorities may include, but are not limited to a loading tool 16 by loading capacity, name, materials 13, and/or blend into a given material processor 18, a material processor 18 by capacity, name (reference), material 13, and/or blend (mix of materials or grades), a material 13 by name, blend, and/or value, or a production arc 20 by reference and/or as referenced by a mine planning document that gives the daily required production.

The order of sorted production arcs 20 may be modified based on the established production priorities 75, 76, 77, 78 so that the particular mining site goals and objectives are emphasized above the optimization algorithm which may use production goals as constraints on the production planning. While the production arcs for the lowest production priorities may be set to 0 later in the process, as detailed below, reordering the sorted production arcs 20 based on the established production priorities after the sorted production arcs 20 have been modified based on the established production goals permits the lower priority arcs 20 to still be considered in the production planning.

Referring to FIGS. 9 through 11, the order of the sorted production arcs 20, as illustrated in FIG. 8, may be modified according to the production arc priorities 75, loading tool priorities 76, the processor priorities 77, and the material priorities 78. As shown in FIG. 9, the order of the sorted production arcs 20, as illustrated in FIG. 8, may be first modified based on loading tool priorities 76. In the illustrated embodiment, the loading tool 16 of the third row 70 has a top loading tool priority 76 and the loading tools 16 of the remaining rows 66, 68, 70 do not have a set loading tool priority 76. Ordered as such, the third row 70 would be first as the loading tool 16 has the top loading tool priority 76 and the remaining rows 66, 68, 70 would remain ordered based on production goals 60, 62, 64, 65.

As shown in FIG. 10, the order of the sorted production arcs 20, as illustrated in FIG. 9, may be further modified based on material priorities 78. In the illustrated embodiment, the material 13 of the fourth row 72 has a top material priority 78 and the materials 13 of the remaining rows 66, 68, 70 do not have a set material priority 78. Ordered as such, the fourth row 72 would be first as the material 13 has the top material priority 78, the third row 70 would be second as it has the highest loading tool priority 76, and the remaining rows 66, 68 would remain ordered based on production goals 60, 62, 64, 65.

As shown in FIG. 11, the order of the sorted production arcs 20, as illustrated in FIG. 10, may be further modified based on processor priorities 77. In the illustrated embodiment, the material processor 18 of the second row 68 has a top processor priority 77 and the material processors 18 of the remaining rows 66, 70, 72 do not have a set processor priority 77. Ordered as such, the second row 68 would be first as the material processor 18 has the top processor priority 77, the fourth row 72 would be second as the material 13 has the top material priority 78, the third row 70 would be third as it has the highest loading tool priority 76, and the first row 66 would be last.

In the illustrated example, the sorted production arcs 20 are modified based on production priorities in inverse priority and are reordered based on loading tool priorities 76 first, material priority 78 second, and processor priority 77 last. As such, the sorted production arcs 20 are rearranged into an order that reflects an order which is first prioritized by material processor 18, then by material 13, and then by loading tool 16. However, the example of FIGS. 9-11 is only illustrative of the general process of reordering production arcs 20 based on priorities 75, 76, 77, 78 and is not exhaustive of the possible reordering. For example, the sorted production arcs 20 may also be modified based on production arc priorities 75 or may be modified in any order of production priorities 75, 76, 77, 78, including being modified by one, two, three, or all four production priorities 75, 76, 77, 78. Further, the sorted production arcs 20 may be modified by based on two or more priorities at once, such as by a top, second, third, etc. priority for any of the production priorities 75, 76, 77, 78.

While the sorted production arcs 20 have been described as being modified based on the established production goals (e.g., production arc production goals 60, loading tool production goals 62, and processor production goals 64) and then modified further based on the established production priorities 75, 76, 77, 78, it will be appreciated that the sorted production arcs 20 may be modified in other orders. For example, the sorted production arcs 20 may be modified based on the established production priorities and then the established production goals or the sorted production arcs 20 may be modified based on the established production goals and the established production priorities simultaneously. Further, the sorted production arcs 20 may be alternatingly modified based on production goals and production priorities, such as being modified by one or more of the production goals 60, 62, 64, 65, then modified based on one or more of the production priorities 75, 76, 77, 78, and then modified based on one or more of the production goals 60, 62, 64, 65, or any other combination thereof.

Figure 12:
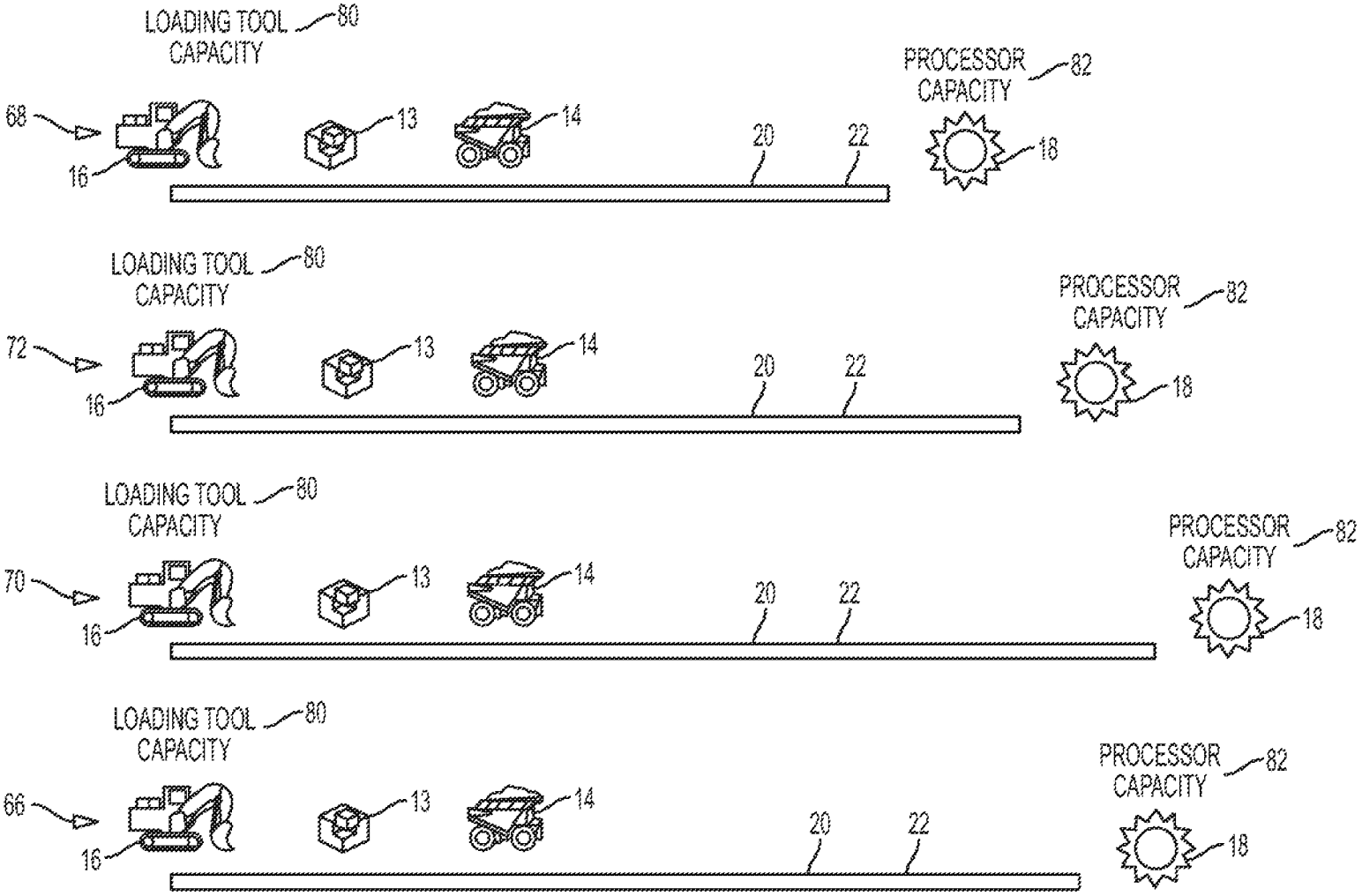
FIG. 12 is a schematic representation of yet another stage in the exemplary method of mining site production planning, according to an aspect of the present disclosure.

Next, referring to FIG. 12, loading tool capacity 80 and processor capacity 82 are associated with the productions arcs 20. According to this next phase, each production arc 20 in the sorted list may be considered in order and available loading tool production and processor production may be associated. In this way, the loading tool capacity 80 and the processor capacity 82 is decremented as each production arc 20 is considered.

Figure 13:
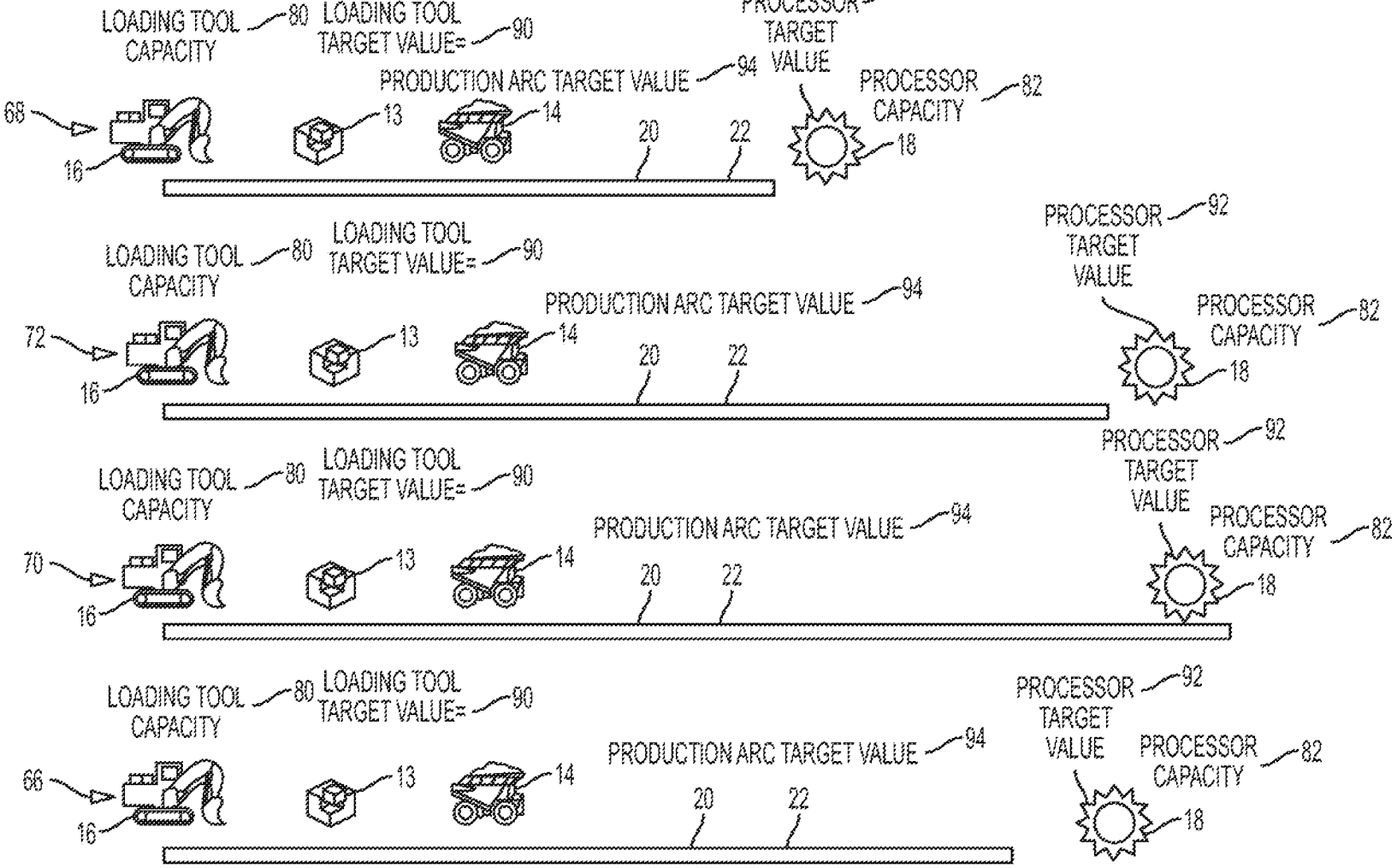
FIG. 13 is a schematic representation of yet another stage in the exemplary method of mining site production planning, according to an aspect of the present disclosure.

At FIG. 13, loading tool target values 90, processor target values 92, and production arc target values 94 are incrementally set based on the loading tool capacity 80 and processor capacity 82. When the loading tool capacity 80 or processor capacity 82 is depleted, then the target value 94 for the arc 20 is set to zero. After this process is completed each loading tool 16, material processor 18, and production arc 20 has a target value 90, 92, 94, respectively.

Figure 14:
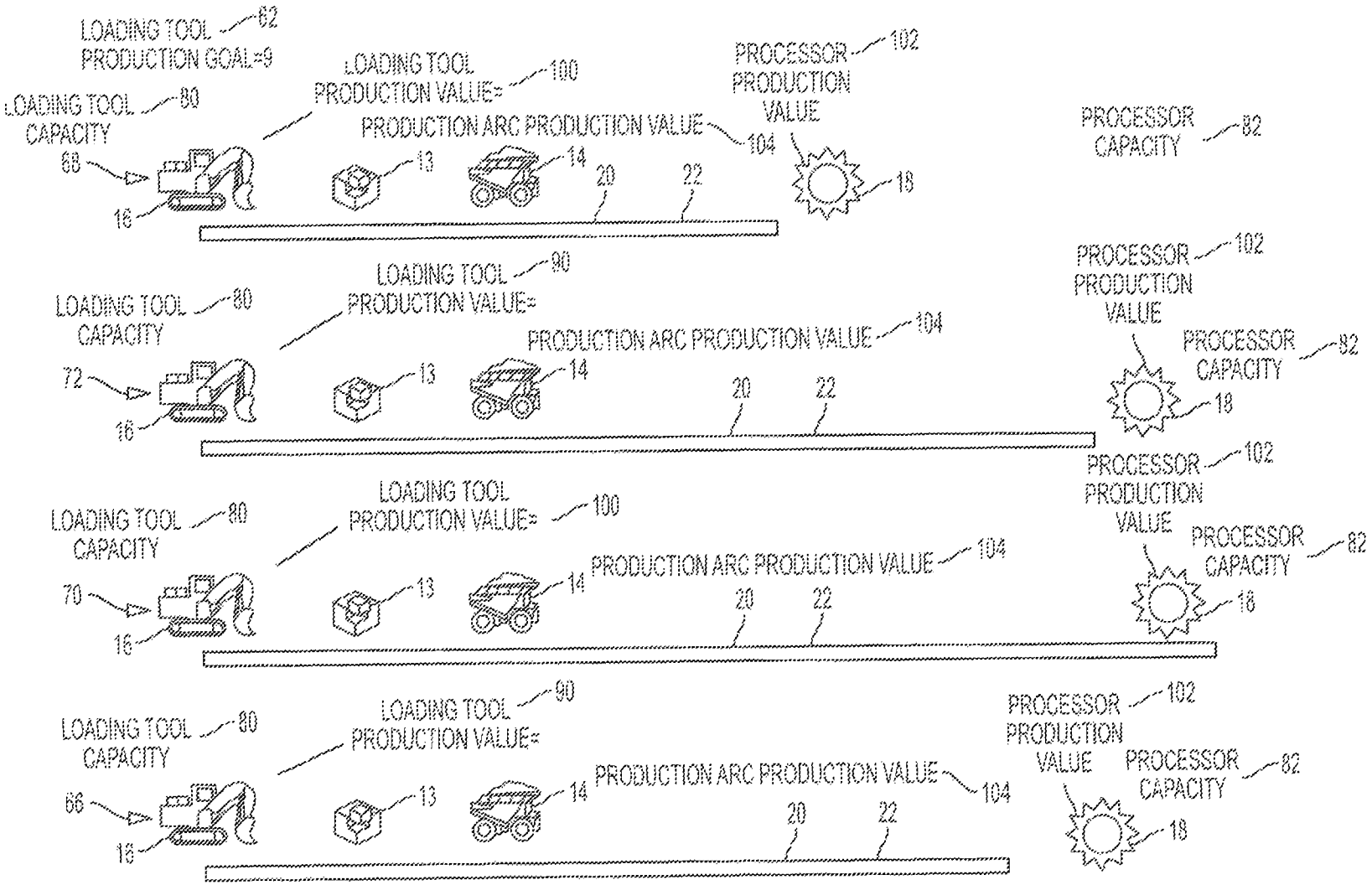
FIG. 14 is a schematic representation of yet another stage in the exemplary method of mining site production planning, according to an aspect of the present disclosure.

At this stage, a least squares algorithm, or other algorithm, is specified and the associated optimization problem can be solved under the constraint that the restraint values should all be positive. The algorithm will then produce production values (e.g., loading tool production values 100, processor production values 102 and production arc production values 104), as illustrated in FIG. 14, based on the target values 90, 92 and 94 for each of the loading tools 16, material processors 18 and production arcs 20 that will optimize the production to meet as close as possible any production goals 60, 62, 64, 65 and/or priorities 75, 76, 77, 78 set by the mine operators as well as maximizing production under the given restrictions. In addition, target values 90, 92, 94 for less productive and/or longer production arcs 20 may be set to zero so that they may be excluded from the calculation. Further, for blend targets to a particular material processor 18 the blend may be decomposed into production level targets on the loading tools 16 that are feeding the blend. These targets can be directly used in the least squares solution.

INDUSTRIAL APPLICABILITY

The system and method for mining site production planning are applicable to a variety of mining sites, including mining sites utilizing mining machines, loading tools, processors, and production arcs. Further, the system and method are applicable to mining sites in which a control system determines route assignments for the mining machines. Yet further, the system and method are applicable to control systems determining route assignments based on a production plan identified for the mining site.

A mining site 12 may include a plurality of materials 13, mining machines 14, loading tools 16, and material processors 18. According to a specific example of operation, each mining machine 14 travels to a loading tool 16 and picks up a load of material 13, such as ore. The mining machine 14 then travels to a material processor 18, where the material 13 is delivered, and then the mining machine 14 restarts the cycle by proceeding again to a loading tool 16. In order to optimize material transport, the mining machine 14 may be directed to a loading tool 16 or material processor 18 based on system guidelines. According to the present disclosure, production priorities are considered, production goals of the mining operators are prioritized, shortest path production is maximized and optimization is achieved using a least squares algorithm. That is, the mining site 12 may be designed with specific targets of type/quantity of material 13 extracted, hauled, and processed by specific loading tools 16 and material processors 18.

Referring generally to FIGS. 1-14, the system 10 of the present disclosure may be designed to maximize the transport of materials 13 from loading tools 16 to material processors 18. In a first stage, a production plan may be calculated that optimizes the usage of the equipment at the mining site 12 and then, in a second stage, individual assignments are calculated according to the restrictions and assignment groups in usage and according to the deviation from the production plan. Because all assignments are based on the deviation from the production plan, it is important that the production plan reflects the implicit and explicit production goals of the mine operators so that the resultant production is in accordance with the mine's production goals. Mine management seeks to not just maximize tons/hour hauled at the mining site 12, but design the mining site 12 with specific targets of type/quantity of material extracted, hauled, and processed by specific loading tools 16 and material processors 18.

The present disclosure relates to the calculation of a production plan that reflects the goals of the mine operators. According to the system 10 and method of the present disclosure, the control system 36 may be configured to specify a problem-solving technique and associated optimization problem for the mining site 12. In particular, production may be optimized by setting goals for each of the available production arcs 20, each of the available loading tools 16, each of the available material processors 18, and each of the materials 13 based on the goals of the mine operators, and then using an algorithm, such as a least squares algorithm, to minimize the difference between the given goals and the calculated production. The optimal solution is one that is closest to the desired production on each of the arcs 20 while considering the capacity of the available loading tools 16 and material processors 18 as well as the number and capacity of the available mining machines 14.

The present disclosure also relates to the calculation of a production plan that reflects the priorities of the mine operators. According to the system 10 and method of the present disclosure, the control system 36 may be configured to specify a problem-solving technique and associated optimization problem for the mining site 12. In particular, production may be optimized by setting production priorities for each of the available production arcs 20, each of the available loading tools 16, each of the available material processors 18, and each of the materials 13 based on the goals of the mine operators, and then using an algorithm, such as a least squares algorithm, to minimize the difference between the given goals and the calculated production. The optimal solution is one that is closest to the desired production priorities on each of the arcs 20 while considering the capacity of the available loading tools 16 and material processors 18 as well as the number and capacity of the available mining machines 14.

Figure 15:
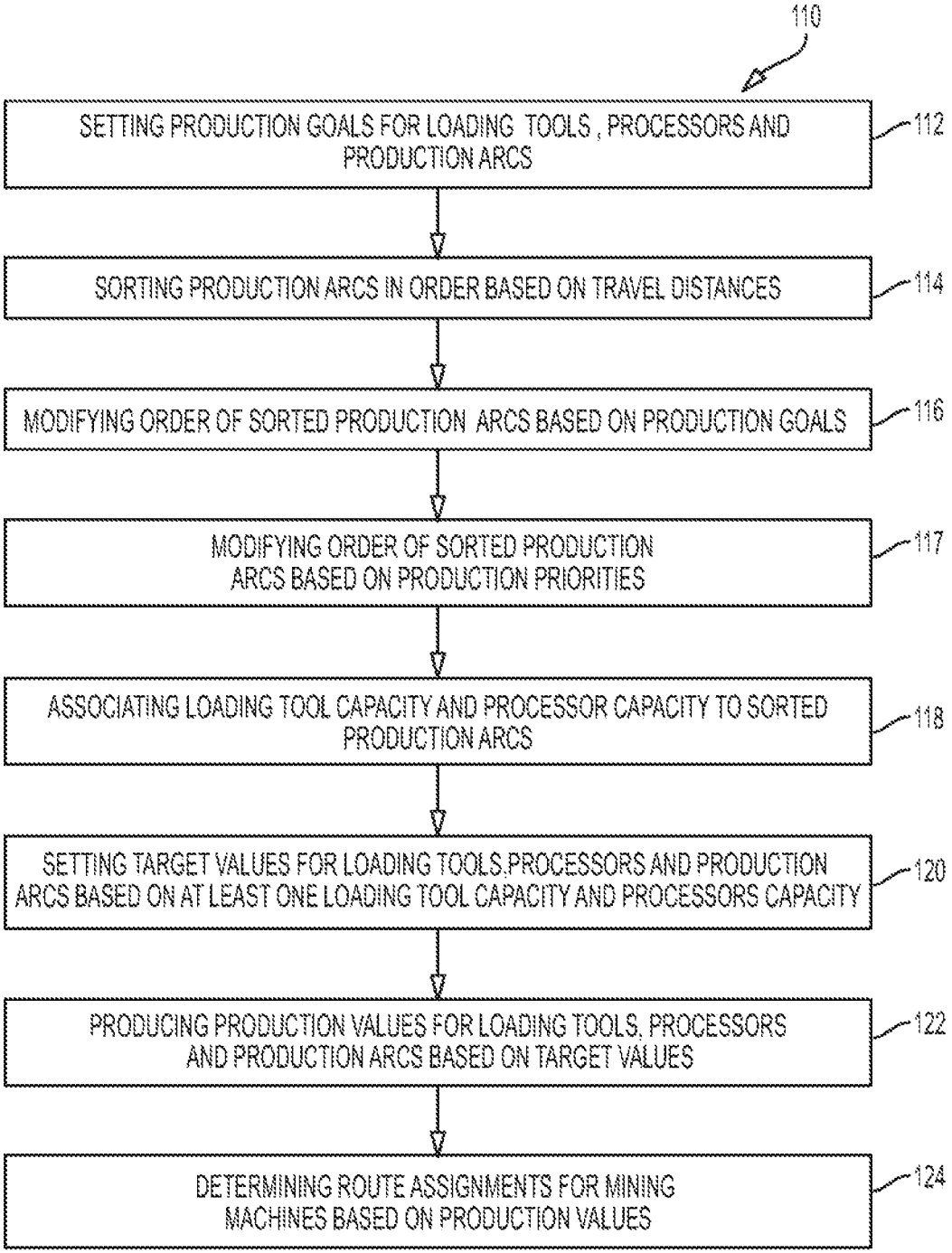
FIG. 15 is a flow diagram representing various stages in the exemplary method of mining site production planning of the present disclosure.

FIG. 15 is a flow diagram 110 representing an exemplary method of mining site production planning using the system 10. In particular, the control system 36 is configured to specify a problem-solving technique and associated optimization problem for the mining site 12 by setting production goals 60, 62, 64, 65 for each of the loading tools 16, material processors 18, production arcs 20, and materials 13, at box 112. At box 114, the production arcs 20 are sorted in an order based on travel distances 74. The order is then modified, at box 116, based on the production goals 60, 62, 64, 65 for each of the loading tools 16, material processors 18, production arcs 20, and materials 13. The order may then be further modified, at box 117, based on the established production priorities 75, 76, 77, 78 previously set or otherwise determined relating to the goals and objectives of the mining operation for each of the loading tools 16, material processors 18, production arcs 20, and materials 13. Alternatively, the order may be based on the established production priorities 75, 76, 77, 78 and then the production goals 60, 62, 64, 65.

Loading tool capacity 80 and processor capacity 82 are associated to the sorted production arcs 20, at box 118. At box 120, target values 90, 92 and 94 are set for the loading tools 16, material processors 18 and production arcs 20 based on at least one of the loading tool capacity 80 and processor capacity 82. Production values 100, 102 and 104 for the loading tools 16, material processors 18, and production arcs 20 are then produced based on the target values 90, 92 and 94, at box 122. At box 124, route assignments for the mining machines 14 are determined based on the production values 100, 102 and 104.

The system 10 and method described herein provide a solution for developing a production plan for a mining site 12 based on specific goals and priorities of operators of the mining site 12, maximization of shortest path production and optimization using an algorithm, such as a least squares algorithm. In particular, the system 10 and method facilitate the specification of particular production and processing of a given material.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A system for mining site production planning, comprising:

a mining site including materials to be mined, loading tools, processors, and production arcs; and a control system configured to:

set production goals for each of the loading tools, material processors, production arcs, and materials to be mined;

sort the production arcs into a first order based on travel distances;

re-sort the first order of the sorted production arcs into a second order based on one of:

the production goal for at least one of the loading tools, material processors, production arcs, and materials to be mined, and a production priority for at least one of the loading tools, material processors, production arcs, and materials to be mined;

re-sort the second order of the sorted production arcs into a third order based on the other of:

the production goal for at least one of the loading tools, material processors, production arcs, and materials to be mined, and the production priority for at least one of the loading tools, material processors, production arcs, and materials to be mined;

set target values for each of the loading tools, material processors, and production arcs according to the third order of the sorted production arcs; and produce production values for each of the loading tools, material processors, and production arcs based on the target values.

2. The system of claim 1, wherein the control system is further configured to determine route assignments for a plurality of mining machines based on the production values for each of the loading tools, material processors, and production arcs.

3. The system of claim 1, wherein the first order is an ascending order based on the travel distances.

4. The system of claim 1, wherein the control system is further configured to specify a problem-solving technique by:

associating a loading tool capacity and a processor capacity to each of the production arcs according to the third order of the sorted production arcs, wherein setting the target values for each of the loading tools, material processors, and production arcs is based on at least one of the loading tool capacity and the processor capacity.

5. The system of claim 1, wherein the production goals for each of the loading tools, material processors, production arcs, and materials to be mined are set based on capacity of at least one of the loading tools, material processors, and production arcs.

6. The system of claim 1, wherein the production goals for each of the loading tools, material processors, production arcs, and materials to be mined are set based on a number of mining machines available for the production arcs.

7. The system of claim 1, wherein the production goals for each of the loading tools, material processors, production arcs, and materials to be mined are set based on a total production capacity.

8. The system of claim 1, wherein the first order of the sorted production arcs is modified based on an inverse priority ordering of the production goals.

9. The system of claim 8, wherein production restrictions are set for each of the sorted production arcs according to the first order of the sorted production arcs.

10. A method for mining site production planning, wherein a mining site includes materials to be mined, loading tools, materials processors, and production arcs, the method including:

receiving production goals for each of the loading tools, material processors, production arcs, and materials to be mined, at a controller;

sorting the production arcs into a first order based on travel distances, using the controller;

re-sorting the first order of the sorted production arcs into a second order based on one of:

the production goal for at least one of the loading tools, processors, production arcs, and materials to be mined, using the controller, and a production priority for at least one of the loading tools, material, processors, production arcs, and materials to be mined, using the controller;

re-sorting the second order of the sorted production arcs into a third order based on the other of:

the production goal for at least one of the loading tools, processors, production arcs, and materials to be mined, using the controller, and the production priority for at least one of the loading tools, material, processors, production arcs, and and materials to be mined, using the controller;

setting target values for each of the loading tools, material processors, and production arcs according to the third order of the sorted production arcs, using the controller; and producing production values for each of the loading tools, material processors, and production arcs based on the target values, using the controller.

11. The method of claim 10, further including determining route assignments for a plurality of mining machines based on the production values for each of the loading tools, material processors, and production arcs.

12. The method of claim 10, further including:

associating a loading tool capacity and a material processor capacity to each of the production arcs according to the third order of sorted production arcs, wherein setting the target values for each of the loading tools, material processors, and production arcs is based on at least one of the loading tool capacity and the material processor capacity.

13. The method of claim 10, wherein the production goals for each of the loading tools, material processors, production arcs, and materials to be mined are set based on capacity of at least one of the loading tools, material processors, and production arcs.

14. The method of claim 10, wherein the production goals for each of the loading tools, material processors, production arcs, and materials to be mined are set based on a number of mining machines available for the production arcs.

15. The method of claim 10, wherein the production goals for each of the loading tools, material processors, production arcs, and materials to be mined are set based on a total production capacity.

16. A control system for mining site production planning, wherein a mining site includes materials to be mined, loading tools, processors, and production arcs, the control system including:

a controller programmed to specify a problem-solving technique and associated optimization problem for the mining site by:

receiving production goals for each of the loading tools, material processors, production arcs, and materials to be mined;

sorting the production arcs into a first order;

re-sorting the first order of the sorted production arcs into a second order based on one of:

the production goal for at least one of the loading tools, material processors, production arcs, and materials to be mined, and a production priority for at least one of the loading tools, material processors, production arcs, and materials to be mined;

re-sorting the second order of the sorted production arcs into a third order based on the other of:

the production goal for at least one of the loading tools, material processors, production arcs, and materials to be mined, and the production priority for at least one of the loading tools, material processors, production arcs, and materials to be mined;

setting target values for each of the loading tools, material processors, and production arcs according to the third order of the sorted production arcs; and solving the optimization problem to produce production values for each of the loading tools, material processors, and production arcs based on the target values.

17. The control system of claim 16, wherein the controller is further programmed to determine route assignments for a plurality of mining machines based on the production values for each of the loading tools, material processors, and production arcs.

18. The control system of claim 16, wherein the first order is an ascending order based on the travel distances.

19. The control system of claim 16, wherein the controller is further programmed to:

associate a loading tool capacity and a material processor capacity to each of the production arcs according to the third order of the sorted production arcs; and set the target values for each of the loading tools, material processors, and production arcs based on at least one of the loading tool capacity and the material processor capacity.

20. The control system of claim 16, wherein the first order of the sorted production arcs is modified based on an inverse priority ordering of the production goals.

* * * * *